US005562109A

United States Patent [19]

Tobiason

[11] Patent Number: 5,562,109

[45] Date of Patent: Oct. 8, 1996

[54] METHOD FOR MATCHING COSMETICS ON AN INDIVIDUAL'S SKIN TO A DESIRED COSMETIC COLOR

[76] Inventor: Karin L. Tobiason, 24 Birds Nest Ct., Mill Valley, Calif. 94941

[21] Appl. No.: 499,897

[22] Filed: Jul. 11, 1995

Related U.S. Application Data

[62] Division of Ser. No. 313,843, Sep. 28, 1994, abandoned.

[51] Int. Cl.[6] ..... G09B 19/00

[52] U.S. Cl. ..... 132/200; 434/100

[58] Field of Search ..... 132/200, 286, 132/317, 319, 333; 434/97, 99, 100, 377

[56] References Cited

U.S. PATENT DOCUMENTS

| | | | |
|---|---|---|---|
| 1,974,466 | 9/1934 | Marshburn | 434/100 |
| 2,020,100 | 11/1935 | Boyd | 434/100 |
| 2,417,677 | 3/1947 | Cohan | 434/100 |
| 5,178,169 | 1/1993 | Lamie | 434/100 |

FOREIGN PATENT DOCUMENTS

| | | | |
|---|---|---|---|
| 1110340 | 10/1955 | France | 434/100 |
| 1236984 | 3/1967 | Germany | 434/100 |

*Primary Examiner*—Todd E. Manahan
*Attorney, Agent, or Firm*—Antonio R. Durando

[57] ABSTRACT

An aid for matching a cosmetic to the skin of an individual has a series of alternating projections and gaps distributed circumferentially of the aid. The aid is designed so that, when it is placed on the hand of an individual, skin is visible in the gaps. The aid is used to compare different shades of a cosmetic with one another. To this end, the projections are marked with respective identifying characters for the different shades. The various shades are applied to the exposed skin in the gaps with each shade being located adjacent to the projection having the corresponding identifying character.

9 Claims, 1 Drawing Sheet

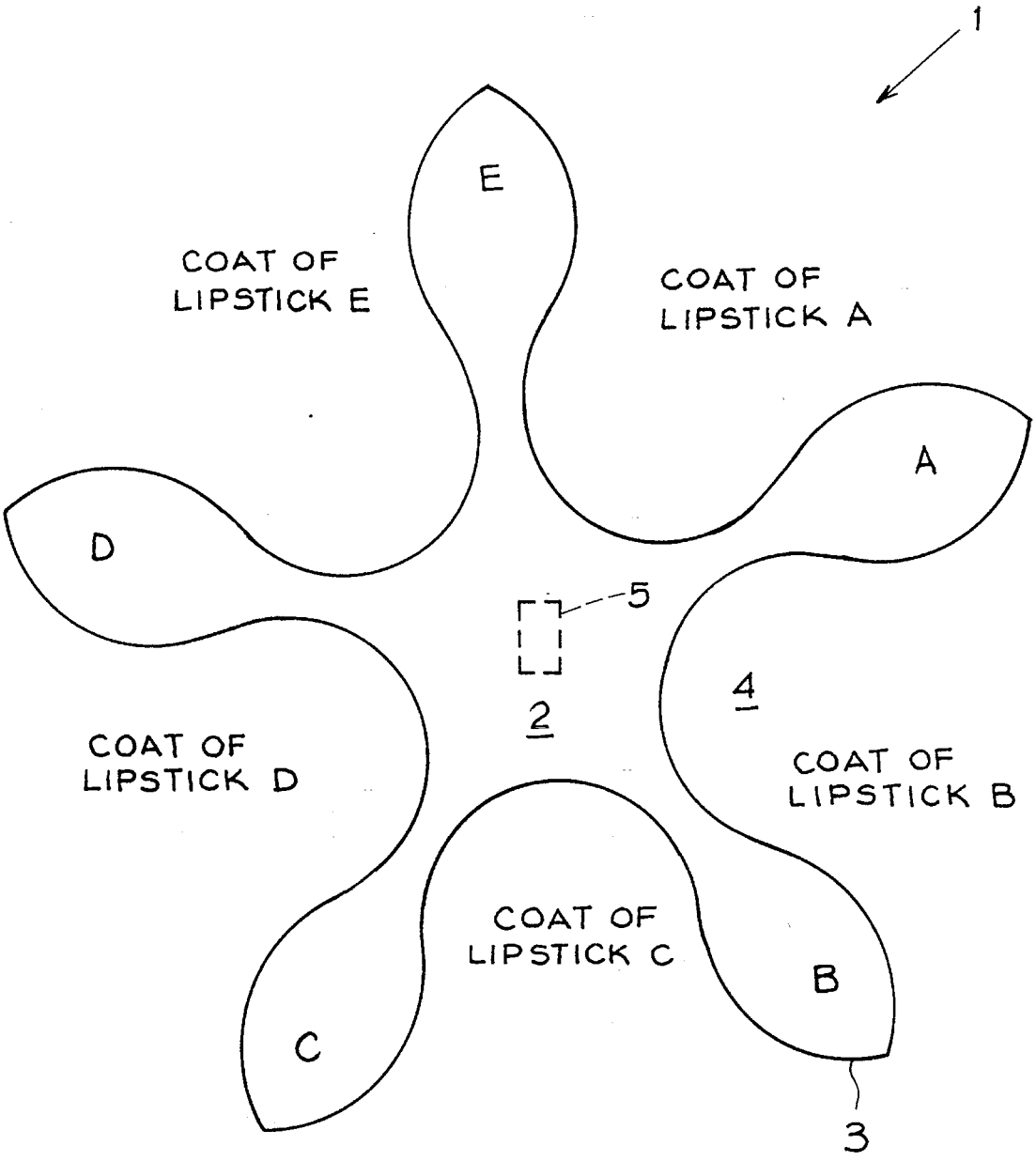
1
E
COAT OF
LIPSTICK E
COAT OF
LIPSTICK A
A
D
5
2
4
COAT OF
LIPSTICK D
COAT OF
LIPSTICK B
COAT OF
LIPSTICK C
B
C
3

METHOD FOR MATCHING COSMETICS ON AN INDIVIDUAL'S SKIN TO A DESIRED COSMETIC COLOR

This application is a division of application Ser. No. 08/313,843, filed Sep. 28, 1994, now abandoned.

BACKGROUND OF THE INVENTION

1. Field of the Invention

The invention relates to an aid for matching a cosmetic to the skin of an individual.

2. Description of the Prior Art

Due to biological, chemical and physical considerations, the coloration of a cosmetic on the skin of an individual frequently differs from the coloration of the cosmetic on other surfaces and from the coloration of the cosmetic in a container. Hence, when an individual purchases a cosmetic, it would be desirable to compare the colorations of different shades of the cosmetic on the skin of the individual in order to ascertain which shade is best suited to the individual.

Various devices for comparing colors are known. Thus, U.S. Pat. No. 1,070,891 illustrates a comparator for assisting a printer in comparing different shades of color with one another. The comparator includes a cardboard base having an opening, and a flap mounted on the cardboard base. An article to be matched is placed between the flap and the base so that the article covers half of the opening. The comparator with the confined article is then placed on a sheet having a series of graded color shades which are successively brought into register with the uncovered half of the opening.

U.S. Pat. No. 1,246,999 teaches an article for matching tooth cement with a tooth. The device comprises a flat, main container having radial extensions which carry flexible tubes. Smaller containers are mounted on the ends of the tubes remote from the extensions and accommodate samples having different shades. The main container is filled with water which keeps the samples moistened to simulate conditions in the mouth.

U.S. Pat. No. 1,871,078 shows a device for simulating various color combinations. The device includes two charts which have respective predominating colors and are divided into sections. In one chart, the predominating color in each section is interrupted by transparent areas, and the ratio of predominating color to transparent area differs for the respective sections. In the other chart, only one of the sections is interrupted by transparent areas. By superimposing the first chart on the second, a plurality of color fields with different proportions of the two predominating colors is observable.

U.S. Pat. No. 1,960,669 discloses a color guide for cosmetics. The guide has a glass plate with a silvered central portion which constitutes a mirror. Below the glass plate is a tray with depressions, and the depressions are provided with respective shades or colors of a cosmetic.

U.S. Pat. No. 2,238,674 illustrates a device for comparing paints. The device consists of two members having alternating projections and notches which are designed so that the projections of one member are receivable in the notches of the other member. The two members are coated with respective paints and thereupon engaged with one another.

U.S. Pat. No. 2,240,053 teaches a color scale comprising a backing and a front plate which are connected to one another by a pivot. The front plate is provided with a window and index markings while the backing has a window in register with that in the front plate. A series of transparent color discs is pivotally mounted between the front plate and the backing, and each disc is formed with a tab and a series of holes. One of the holes is aligned with the windows in the front plate and the backing whenever the tab of the respective disc registers with an index marking of the front plate. The scale is laid against a colored surface to be matched and the discs rotated until the color in the window of the front plate matches the color of the surface. Such a match is indicated by a disappearance of the hole or holes in the window.

U.S. Pat. No. 2,285,709 shows a color chart on a lipstick container. A cover overlies the color chart and has an opening which can be brought into alignment with any of the colors on the color chart. The color chart is used to select cosmetics and clothes which match the lipstick in the lipstick container.

U.S. Pat. No. 2,623,304 discloses a folder for matching lipstick to lip colorings. The folder includes a first panel which carries a series of color tones, a second panel containing a series of natural lip colors and a third panel provided with a cutout. A mirror can be placed in the cutout or, alternatively, the first and second panels can be folded over the cutout to superimpose the natural lip colors of the second panel with the color tones of the first panel.

U.S. Pat. No. 3,519,360 shows an apparatus for visually comparing a pair of color samples. The apparatus comprises a front plate having a mask for holding the color samples, a back plate which carries a light source for illuminating the samples, a viewing plate having a slit for observing the samples, and a bottom plate which supports the front and back plates. The front and back plates are pivotally mounted on the bottom plate while the viewing plate is pivotally mounted on the back plate.

U.S. Pat. No. 4,523,852 teaches a color reference standard for evaluating the results of colorimetric analytical tests. The standard is made up of a chart having a series of color blocks.

The luminance of any portion of the background of the chart is within 30 units of the average luminance of any adjacent color blocks.

U.S. Pat. No. 4,561,850 illustrates a color coordinator made up of front and rear panels which confine a rotatable disc and are provided with registering cutouts extending through 90 degrees. The front face of the disc is divided into four quadrants each of which corresponds to a different skin color classification. A first annular band of the front face represents four major color categories of the human skin, a second annular band represents three corresponding eye colors, third and fourth annular bands represent compatible eye shadow colors, a fifth annular band represents matching hair tints, and a sixth annular band represents harmonious blush and/or rouge colors. Two additional annular bands contain nail polish and lipstick colors which are compatible with the respective skin tones. The rear face of the disc is likewise divided into four quadrants and is provided with a multiplicity of annular bands having colors which harmonize with the skin tones of the corresponding quadrant. The rear face of the disc is used in the selection of a wardrobe and accessories suited to a particular skin tone.

U.S. Pat. No. 4,608,015 discloses a device for choosing a bonding composite which neutralizes the discoloration of a tooth. The device includes a transparent upper disc which is divided into a plurality of regions each having the coloration of a different bonding composite. The device further includes an opaque lower disc containing regions representative of various tooth discolorations. The discs are rotatably connected to one another so that the regions of the upper disc can be selectively superimposed on the regions of the lower disc in order to find a desired resultant coloration.

U.S. Pat. No. 4,681,546 shows an article for determining the skin tone of an individual. The article comprises a case having a white first inner face and a second inner face provided with a spectral table. A series of color filters is pivotally mounted on the white inner face of the case. In operation, the white inner face is held next to the skin of an individual and the filters are stacked into an array which, when viewed against the white background, closely matches the skin tone of the individual. The type of skin tone possessed by the individual can then be determined from the spectral table based on a knowledge of the filters in the array.

U.S. Pat. No. 4,820,163 teaches an artist's aid which includes a rectangular sheet member having a gray scale as well as a rectangular aperture covered by a green filter. The rectangular aperture functions to determine differences in reflective light along various surfaces. The sheet member further has a square aperture for isolating a small portion of an object, and a group of three circular apertures for separating a plurality of objects in a visual field. A scale for measuring lengths, angles and perspectives is pivotally mounted on one corner of the sheet member.

U.S. Pat. No. 4,909,632 illustrates a color chart, as well as a package containing swatches of fabric which are intended to assist an individual in selecting apparel, cosmetics and hair tints having colors compatible with the individual's skin.

U.S. Pat. No. 5,178,169 discloses a strip which is divided longitudinally into a series of regions having different shades, tones or colors of cosmetics. The strip is pressed against the forehead of an individual to ascertain the best match with the skin of the individual.

Finally, U.S. Pat. No. 5,217,377 shows a kit for matching paint to be applied to a repaired surface portion of an automobile with the existing paint of the automobile. The kit includes a plurality of testing members each of which is coated with a different primer. When painting a repaired surface portion of an automobile, the paint is first applied to the testing member having the same primer as the repaired surface portion. The painted testing member is then held adjacent the existing paint of the automobile to determine whether there is a match.

None of the above publications recognizes that biological, chemical and physical factors can cause the appearance of the same cosmetic to differ depending upon whether the cosmetic is in a container, on the skin of a particular individual, on the skin of a different individual, or on another surface. However, it would be desirable for an individual to know how a cosmetic looks on the individual before committing to a purchase of the cosmetic.

BRIEF SUMMARY OF THE INVENTION

It is therefore an object of the invention to provide a device which enables an individual to compare the appearances of different cosmetics on the individual while maintaining identification of the cosmetics.

A further object of the invention is to provide a method which allows a comparison to be made between the appearances of different cosmetics on an individual without losing track of the cosmetics.

The preceding objects, as well as others which will become apparent as the description proceeds, are achieved by the invention.

One aspect of the invention resides in an aid for matching a cosmetic to the skin of an individual. The aid comprises a member having a plurality of marking areas for the application of marks identifying respective cosmetics to be tested. The member is dimensioned so that it can be placed on the hand of the individual with each of the marking areas adjacent an exposed patch of skin.

When an individual wishes to select one of a plurality of cosmetics, the aid is placed on the hand and different ones of the marking areas are provided with marks representative of different ones of the cosmetics. The exposed patches of skin adjacent the marks are then coated with the respective cosmetics. The individual can now compare the appearances of the various cosmetics knowing that these are the true, or very nearly the true, appearances of the cosmetics on the individual since the cosmetics are on the individual's own skin. Moreover, inasmuch as each cosmetic is located next to an identifying mark, the individual does not lose track of the cosmetics.

Another aspect of the invention resides in a method of matching a cosmetic to the skin of an individual. The method comprises the steps of creating a plurality of marks each of which identifies a respective cosmetic, applying a coat of each cosmetic to the skin of the individual adjacent the respective mark, and comparing the coats.

The method may further comprise the step of releasably bonding marking areas to the skin of the individual prior to the applying step. The marks may then be made on such areas.

BRIEF DESCRIPTION OF THE DRAWING

Additional features and advantages of the invention will be forthcoming from the following detailed description of preferred embodiments when read in conjunction with the accompanying drawing.

The sole Figure is an enlarged plan view of an aid according to the invention for matching a cosmetic to the skin of an individual.

DESCRIPTION OF THE PREFERRED EMBODIMENTS

Referring to the Figure, an aid in accordance with the invention for matching a cosmetic to the skin of an individual is identified by the reference numeral 1. The term cosmetic as used herein is intended to include all substances which are applied to the skin in order to enhance the appearance of an individual. Examples of such substances are lipstick, blush, eye shadow and powder.

The aid 1, which can be made of sheet-like material, has a central main section or support section 2. Five projections 3 extend radially outward from the central section 2, and neighboring ones of the projections 3 define gaps 4. The projections 3 and gaps 4 alternate, and are preferably uniformly distributed, circumferentially of the aid 1. The aid 1 is dimensioned in such a manner that, when placed on the hand of an individual, a patch of skin is visible in each of the gaps 4.

The upward facing major surface of the aid 1, as seen in the Figure, preferably has a uniform color. The surface portions of the projections 3 which form part of the upward facing major surface of the aid 1 constitute marking areas and are advantageously essentially impermeable or nonporous so that marks made on these surface portions can be removed relatively easily.

The downward facing major surface of the aid 1, again as seen in the Figure, is provided with an adhesive element 5 which allows the aid 1 to be releasably secured to the skin of an individual. The adhesive element 5 is disposed on the central section 2 of the aid 1.

By way of example, the aid 1 can be made of plastic-sheet material, thin metal sheet, or any nonporous paper-good material.

The operation of the aid 1 will now be described assuming that an individual likes five different lipsticks A, B, C, D and E and wishes to select the lipstick which best matches the skin or complexion of the individual. The individual affixes the aid 1 to a hand by means of the adhesive element 5. The aid 1 is positioned on the hand in such a manner that a patch of skin is visible in each of the gaps 4.

Each of the projections 3 is now marked with a symbol, such as one of the letters A, B, C, D and E, which identifies one of the various lipsticks. This is illustrated in the Figure. After the projections 3 have been marked, a coat of lipstick is applied to the exposed skin in each of the gaps 4. The lipstick used in each gap 4 corresponds to the lipstick identified on one of the adjacent projections 3. As shown for example in the Figure, the lipstick in any one of the gaps 4 here corresponds to the lipstick which is identified on the projection 3 immediately downstream of the respective gap 4 as considered clockwise of the aid 1.

Once coats of lipstick have been applied to the exposed skin in the gaps 4, the individual using the aid 1 compares the different lipsticks as they appear after application on the skin with the color of the preferred lipstick to ascertain which of them most closely matches that color on the individual's skin. The lipstick giving the best match may then be selected for purchase. The individual can be confident that the appearance of the selected lipstick in the respective gap 4 is the true appearance, or very nearly the true appearance, for the individual. Thus, the selected lipstick is seen on the individual's own skin thereby eliminating most or all of the variables which could cause the appearance of the selected lipstick to change. Furthermore, due to the identifying letters on the projections 3, the individual can readily keep track of the different lipsticks applied to the individual's hand.

It will be observed that the illustrated aid 1 with the five projections 3 can be used to compare up to five cosmetics at one time.

Various modifications can be made within the meaning and range of equivalence of the appended claims. For instance, the aid 1 can have more or less than five projections, and each projection may have any shape suitable for the function herein described. Moreover, the projections 3 can be marked before the aid 1 is affixed to the hand of the individual or, alternatively, each projection 3 can be marked after the corresponding lipstick has been applied to the exposed skin in the adjacent gap 4. It is further possible to replace the adhesive element 5 with another means for securing the aid 1 to the hand of an individual.

I claim:

1. A method of matching a cosmetic color on an individual's skin to a desired cosmetic color, comprising the steps of;

(a) providing a member having a plurality of marking areas for the application of marks identifying respective cosmetics to be tested, said member being dimensioned so that said member can be placed on the hand of the individual with each of said areas adjacent an exposed patch of skin;

(b) placing said member on the hand of the individual with each of said areas adjacent an exposed patch of skin;

(c) creating a plurality of marks on the member, each of which identifies a respective cosmetic;

(d) applying a coat of each of said cosmetics to be tested to the skin of the individual adjacent the respective mark; and (e) comparing said coats to said desired cosmetic color.

2. The method of claim 1, wherein said member has a pair of opposed surfaces and said areas are provided on one of said surfaces; further comprising means on the other of said surfaces to releasably affix said member to the skin of the individual; and further comprising the step of releasably bonding marking areas to the skin of the individual prior to the applying step.

3. The method of claim 1, wherein said member comprises sheet-like material.

4. The method of claim 1, wherein said areas are substantially impermeable to permit substantially complete removal of the marks therefrom.

5. The method of claim 1, wherein said member has a surface and said areas are provided on said surface, said surface having substantially uniform coloration.

6. The method of claim 1, wherein said member has a support section and a pair of projections extending from said support section, said projections defining a gap for exposing a patch of skin when said member is placed on the hand of the individual.

7. The method of claim 1, wherein said member has a support section and a multiplicity of projections extending from said support section, said projections defining gaps which alternate with said projections.

8. The method of claim 7, wherein said projections and said gaps are distributed circumferentially of said support section.

9. The method of claim 8, wherein said projections and said gaps are arranged substantially uniformly circumferentially of said support section.

* * * * *